US008276901B2

(12) United States Patent
Taniguchi et al.

(10) Patent No.: US 8,276,901 B2
(45) Date of Patent: Oct. 2, 2012

(54) PAPER SHEET HANDLING APPARATUS AND PAPER SHEET HANDLING METHOD

(75) Inventors: Tetsuya Taniguchi, Hyogo (JP); Kaname Kotani, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 19 days.

(21) Appl. No.: 12/736,166

(22) PCT Filed: Mar. 26, 2008

(86) PCT No.: PCT/JP2008/000733

§ 371 (c)(1),
(2), (4) Date: Sep. 16, 2010

(87) PCT Pub. No.: WO2009/118782

PCT Pub. Date: Oct. 1, 2009

(65) Prior Publication Data

US 2011/0133395 A1 Jun. 9, 2011

(51) Int. Cl.
*G07F 7/04* (2006.01)

(52) U.S. Cl. ..... 270/60; 270/47; 270/19; 194/206; 194/229

(58) Field of Classification Search ..... 270/60, 270/47, 19, 13, 36; 194/206, 229
See application file for complete search history.

(56) References Cited

U.S. PATENT DOCUMENTS 5,735,516 A 4/1998 Gerlier et al.
5,772,197 A 6/1998 Aoki et al. ..... 270/58.08
6,019,209 A * 2/2000 Hara et al. ..... 194/206
6,219,503 B1 4/2001 Miyake et al. ..... 399/85
6,273,413 B1 8/2001 Graef ..... 271/3.14
6,381,443 B1 4/2002 Kawata et al. ..... 399/407
6,749,053 B2 * 6/2004 Ikuta ..... 194/206
7,900,900 B2 * 3/2011 Kotani ..... 270/47
2003/0006548 A1 1/2003 Murata et al. ..... 271/256
(Continued)

FOREIGN PATENT DOCUMENTS

EP 1 315 127 A2 5/2003
(Continued)

OTHER PUBLICATIONS

European Supplementary Search Report (dated Jul. 4, 2011—7 pages).

(Continued)

*Primary Examiner* — Patrick Mackey
(74) *Attorney, Agent, or Firm* — Renner, Kenner, Greive, Bobak, Taylor & Weber

(57) ABSTRACT

A paper sheet handling apparatus includes a transport unit having a main transport path and a return transport path, a detection unit arranged at a predetermined detection position in the main transport path, and a controller controlling the transport unit based on the detection result of the detection unit. The controller leads, at the diversion position in the main transport path, a paper sheet transported along the main transport path into the return transport path, transports a subsequent paper sheet along the main transport path, and controls the transportation of the paper sheet and the transportation of the subsequent paper sheet respectively in response to the arrival of the subsequent paper sheet at the detection position such that the paper sheets are stacked into a batch at the joining position of the two transport paths with certain parts of the paper sheets being aligned.

11 Claims, 8 Drawing Sheets

U.S. PATENT DOCUMENTS

| | | | | |
|---|---|---|---|---|
| 2003/0094402 | A1 | 5/2003 | Seo et al. | 209/534 |
| 2004/0145111 | A1 | 7/2004 | Nishida et al. | 271/207 |
| 2005/0067748 | A1 | 3/2005 | Fujii et al. | 270/58.08 |
| 2005/0126880 | A1* | 6/2005 | Iannello et al. | 194/206 |
| 2006/0181000 | A1 | 8/2006 | Nishida et al. | 271/176 |
| 2007/0221469 | A1* | 9/2007 | Katou et al. | 194/206 |
| 2008/0150224 | A1* | 6/2008 | Shimizu et al. | 271/263 |
| 2009/0107799 | A1* | 4/2009 | Kadowaki et al. | 194/206 |
| 2010/0007080 | A1 | 1/2010 | Kotani | 271/207 |
| 2010/0213023 | A1* | 8/2010 | Freitag et al. | 194/206 |
| 2011/0005892 | A1* | 1/2011 | Ohishi | 194/206 |
| 2011/0048891 | A1* | 3/2011 | Iwami | 194/206 |
| 2011/0198192 | A1* | 8/2011 | Togiya et al. | 194/206 |

FOREIGN PATENT DOCUMENTS

| | | | |
|---|---|---|---|
| EP | 1 415 942 | A2 | 5/2004 |
| JP | 04-372093 | | 12/1992 |
| JP | 09-267962 | | 10/1997 |
| JP | 2000-011238 | | 1/2000 |
| JP | 2005-293389 | | 10/2005 |
| WO | WO 96/15511 | A1 | 5/1996 |
| WO | WO 99/28870 | A2 | 6/1999 |

OTHER PUBLICATIONS

Office Action in U.S. Appl. No. 12/169,276 (Notification Date Jun. 25, 2010, 8 pages).

* cited by examiner

PAPER SHEET HANDLING APPARATUS AND PAPER SHEET HANDLING METHOD

TECHNICAL FIELD

The present invention relates to a paper sheet handling apparatus and a paper sheet handling method.

BACKGROUND ART

PATENT DOCUMENT 1 discloses a banknote depositing device as an example of a paper sheet handling apparatus which handles a paper sheet such as a banknote, a check and a ticket. The banknote depositing device allows a recognition section to recognize whether a banknote introduced into a casing through a depositing port is acceptable or not. If a plurality of banknotes are recognized as unacceptable, then the banknotes are rejected, stacked into a batch and discharged through a return port. However, the banknote depositing device is configured to drop the plurality of rejected banknotes sequentially on a stage and stack them into a batch without aligning the edges of the banknotes. Therefore, when the batch discharged out of the return port includes a different-sized banknote and the edges of the banknotes are not aligned, a user may fail to pick up the shorter banknote and drop it. In addition, the batch of misaligned banknotes is not preferable in view of appearance.

PATENT DOCUMENT 2 discloses a stacking device capable of stacking banknotes of different sizes into a batch with the rear edges of the banknotes being aligned. The stacking device is configured such that banknotes are sequentially introduced into a stacking space having a substantially rectangular box shape and stacked there. A stopper corresponding to the length of the introduced banknotes is provided in the stacking space such that the banknotes are stacked in the stacking space with the rear edges thereof kept in contact with a rear wall of the stacking space. However, in the stacking device, the state of the stopper has to be changed depending upon the length of the introduced banknotes, thereby requiring that the banknote length should be detected in advance. In addition, if banknotes introduced into the stacking space each have a different length, then the state of the stopper has to be changed every time a banknote is introduced, thereby hindering the banknotes from being rapidly stacked.

PATENT DOCUMENT 3 discloses a depositing and dispensing machine which includes a stacking mechanism formed by a first transport path for transporting a banknote and a second transport path joining the first transport path at a middle position thereof. The stacking mechanism synchronizes transportation of a banknote along the first transport path with transportation of a banknote along the second transport path and thereby stacks the banknotes at the joining position of the first and second transport paths with the front edges thereof aligned. However, in order to stack many banknotes successively, the stacking mechanism needs to move a batch of banknotes back and forth beyond the joining position on the first transport path. This lengthens the time taken to stack the banknotes, and further, necessitates a transport path long enough to move the banknotes back and forth, thereby requiring a larger space inside of a casing.

PATENT DOCUMENT 4 discloses a banknote depositing-and-dispensing machine provided with a winding-type storage section. The banknote depositing-and-dispensing machine is capable of storing different-sized banknotes one by one and feeding the stored banknotes one by one with reliability, but incapable of stacking the banknotes into a batch.

Citation List

Patent Document

PATENT DOCUMENT 1: Japanese Patent Publication No. 2003-157461

PATENT DOCUMENT 2: Japanese Patent Publication No. 2004-149264

PATENT DOCUMENT 3: U.S. Pat. No. 6,273,413

PATENT DOCUMENT 4: Japanese Patent Publication No. 2000-11238

SUMMARY OF THE INVENTION

Technical Problem

With the foregoing in mind, the present invention has been achieved. An object of the present invention is to provide a paper sheet handling apparatus and a paper sheet handling method capable of stacking a plurality of paper sheets into a batch with the paper sheets being aligned and capable of performing the stacking procedure rapidly without a larger space inside of the paper sheet handling apparatus.

Solution to the Problem

A paper sheet handling apparatus according to an aspect of the present invention includes: a casing having an opening through which a paper sheet passes; a storage unit arranged inside of the casing and storing the paper sheet; a transport unit which includes a main transport path connecting the opening and the storage unit and a return transport path diverting from the main transport path at a predetermined position thereof and joining the main transport path at a position upstream in the transport direction from the diversion position, and transports the paper sheet along the main transport path and the return transport path; a detection unit arranged at a detection position upstream in the transport direction from the joining position of the main transport path and detecting the arrival of the paper sheet transported along the main transport path at the detection position; and a controller controlling the transport unit based on the detection result of the detection unit such that a plurality of the paper sheets are stacked into a batch with certain parts of the paper sheets being aligned.

The controller performs a procedure including the steps of (I) leading, at the diversion position, the paper sheet transported along the main transport path into the return transport path, (II) transporting a subsequent paper sheet along the main transport path, and (III) controlling the transportation of the paper sheet on the return transport path and the transportation of the subsequent paper sheet on the main transport path respectively in response to the arrival of the subsequent paper sheet at the detection position such that the two paper sheets are stacked into a batch at the joining position with certain parts of the paper sheets being aligned.

According to this configuration, a part of the main transport path and the return transport path enables a paper sheet to circulate, and a looped transport path for holding paper sheets (and a batch thereof) on standby in the return transport path is provided between the opening and the storage unit.

The looped transport path makes it possible to stack a plurality of paper sheets into a batch with the paper sheets being aligned. Specifically, a paper sheet (a first paper sheet) traveling along the main transport path is led at the diversion position into the return transport path and another paper sheet (a second paper sheet) is transported along the main transport path. Then, the transportation of the first paper sheet on the return transport path and the transportation of the second paper sheet on the main transport path are respectively controlled in response to the arrival of the second paper sheet at the detection position on the main transport path. As a result, the first and second paper sheets can be stacked into a batch at the joining position of the main transport path and the return transport path with certain parts of the paper sheets being aligned. The "certain parts" of the paper sheets may be, for example, the front edges or the rear edges thereof. In this manner, a plurality of paper sheets can be stacked into a batch with the certain parts thereof aligned.

According to this configuration, the looped transport path as a part of the stacking mechanism is formed by utilizing a part of the main transport path, thereby reducing the space necessary for providing the stacking mechanism.

The controller may further perform the steps of (IV) transporting the batch along the main transport path and leading, at the diversion position, the batch into the return transport path, (V) transporting a subsequent paper sheet along the main transport path, (VI) controlling the transportation of the batch on the return transport path and the transportation of the subsequent paper sheet on the main transport path respectively in response to the arrival of the subsequent paper sheet at the detection position such that the batch and the subsequent paper sheet are stacked into a new batch at the joining position with certain parts of the paper sheets being aligned, and (VII) repeating the steps (IV)-(VI) in order as many times as required and creating a batch of a predetermined number of stacked paper sheets.

According to these steps, every time a batch of paper sheets revolves through the looped transport path, a new paper sheet can be stacked on the batch with certain parts of the paper sheets being aligned, thereby creating a batch of a desired number of paper sheets. According to this configuration, a plurality of paper sheets are stacked by revolving a batch of paper sheets through the looped transport path, thereby shortening the time taken to stack the paper sheets as compared with the case where a batch of paper sheets go back and forth on a transport path.

The controller may further perform the step of (VIII) transporting the batch along the main transport path and discharging the batch out of the casing through the opening.

According to this step, a batch of a desired number of aligned paper sheets is discharged out of the casing through the opening. A plurality of paper sheets are discharged all at once to thereby prevent a user from failing to pick up any of them. In addition, the paper sheets are aligned to thereby enable the user to grab the batch of paper sheets more easily without leaving any of them.

When paper sheets are discharged, the controller may feed the paper sheets one by one out of the storage unit, stack the fed paper sheets into a batch with certain parts of the paper sheets being aligned and discharge the batch out of the casing through the opening.

The storage unit may store paper sheets while winding the paper sheets one by one and feed the wound paper sheets one by one.

The paper-sheet stacking operation using the looped transport path requires the transportation of paper sheets one by one to the joining position. The winding-type storage unit which stores paper sheets while winding the paper sheets one by one and feeds the wound paper sheets one by one is capable of transport the paper sheets one by one with reliability from the storage unit to the joining position. Therefore, the winding-type storage unit is suitable for the paper-sheet stacking operation.

The paper sheet handling apparatus may further include a cassette which is detachably attached to the casing and capable of storing a paper sheet for replenishing the storage unit and a paper sheet collected from the storage unit, wherein the cassette is connected to the return transport path via a diversion transport path diverting from the return transport path.

According to this configuration, the return transport path forms a part of the transport path connecting the cassette to the main transport path. In other words, the return transport path for forming the stacking mechanism is also employed for the different purpose, thereby further reducing the space necessary for providing the stacking mechanism.

A paper sheet handling method according to another aspect of the present invention is a method for discharging a paper sheet out of a casing through a discharge port. The handling method includes the steps of: (i) transporting a paper sheet fed out of a storage unit inside of the casing along a main transport path and leading the paper sheet into a return transport path diverting from the main transport path; (ii) feeding a subsequent paper sheet out of the storage unit and transporting the subsequent paper sheet along the main transport path; (iii) controlling the transportation of the paper sheet on the return transport path and the transportation of the subsequent paper sheet on the main transport path respectively in response to the arrival of the subsequent paper sheet at a predetermined arrival position of the main transport path such that the paper sheets are stacked into a batch at a joining position of the return transport path and the main transport path with certain parts of the paper sheets being aligned; and (iv) transporting the batch along the main transport path and discharging the batch out of the casing through the discharge port.

In addition, the paper sheet handling method may further include the steps of, after the step (iii), (v) transporting the batch along the main transport path and leading, at the diversion position, the batch into the return transport path, (vi) transporting a subsequent paper sheet along the main transport path, (vii) controlling the transportation of the batch on the return transport path and the transportation of the subsequent paper sheet on the main transport path respectively in response to the arrival of the subsequent paper sheet at the arrival position such that the batch and the subsequent paper sheet are stacked into a new batch at the joining position with certain parts of the paper sheets being aligned, and (viii) performing the step (iv) after repeating the steps (v)-(vii) as many times as required.

A paper sheet handling method according to still another aspect of the present invention is a method for accepting a paper sheet introduced into an opening. The handling method includes the steps of: (i) transporting the paper sheet introduced into the opening along a main transport path and leading the paper sheet into a return transport path diverting from the main transport path; (ii) transporting a subsequent paper sheet introduced into the opening along the main transport path; (iii) controlling the transportation of the paper sheet on the return transport path and the transportation of the subsequent paper sheet on the main transport path respectively in response to the arrival of the subsequent paper sheet at a predetermined arrival position of the main transport path such that the paper sheets are stacked into a batch at a joining position of the return transport path and the main transport path with certain parts of the paper sheets being aligned; (iv) leading, at the diversion position, the batch into the return transport path; and (v) repeating the steps (ii)-(iv) every time a paper sheet is introduced into the opening.

The handling method may further include the step of (vi) transporting the formed batch to a feeding unit, feeding the paper sheets of the batch one by one out of the feeding unit and storing the paper sheets in a storage unit.

The handling method may further include the step of (vii) transporting the formed batch along the main transport path and discharging the batch through the opening when the storage of the paper sheets is canceled.

Advantages of the Invention

According to the present invention, a part of the main transport path and the return transport path constitute the stacking mechanism including the looped transport path. Therefore, a plurality of paper sheets can be rapidly stacked into a batch with the paper sheets being aligned, and further, the apparatus can be downsized because there is no need to provide a large space for the stacking mechanism.

DESCRIPTION OF EMBODIMENT

As an example of a paper sheet handling apparatus according to the present invention, an embodiment of a banknote depositing and dispensing machine will be below described in detail with reference to the drawings. The following description of the preferred embodiment is essentially provided only for an illustration, and hence, the present invention, the one applied thereto or the use thereof is not supposed to be limited.

Figure 1:
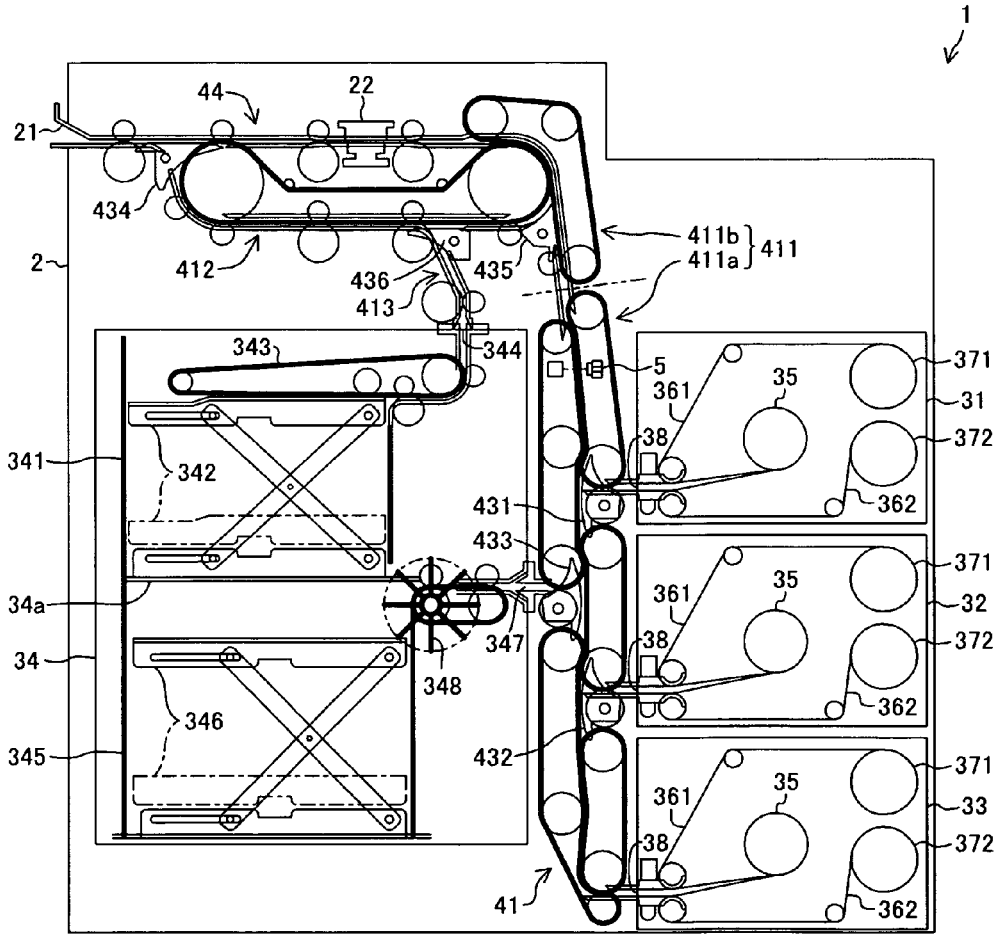
FIG. 1 is a view illustrating a configuration of a depositing and dispensing machine according to an embodiment of the present invention.

FIG. 1 shows an internal configuration of a depositing and dispensing machine 1 according to this embodiment. The depositing and dispensing machine 1 includes: a depositing-and-dispensing port 21 connecting the inside and the outside of a casing 2 and allowing a banknote to pass through; a recognition unit 22 arranged inside of the casing 2 and recognizing the authentication, denomination and fitness of every banknote; first to third stackers 31-33 arranged inside of the casing 2 and each capable of storing a banknote and feeding a banknote in store; a cassette 34 detachably attached to the casing 2; and a transport path 41 connecting the depositing-and-dispensing port 21, the recognition unit 22, the first to third stackers 31-33 and the cassette 34. The depositing and dispensing machine 1 also includes a transport drive unit 42 (see FIG. 3) transporting a banknote and a batch of banknotes along the transport path 41. In the following description, the "banknote transportation" may include transportation of a batch of banknotes.

Figure 3:
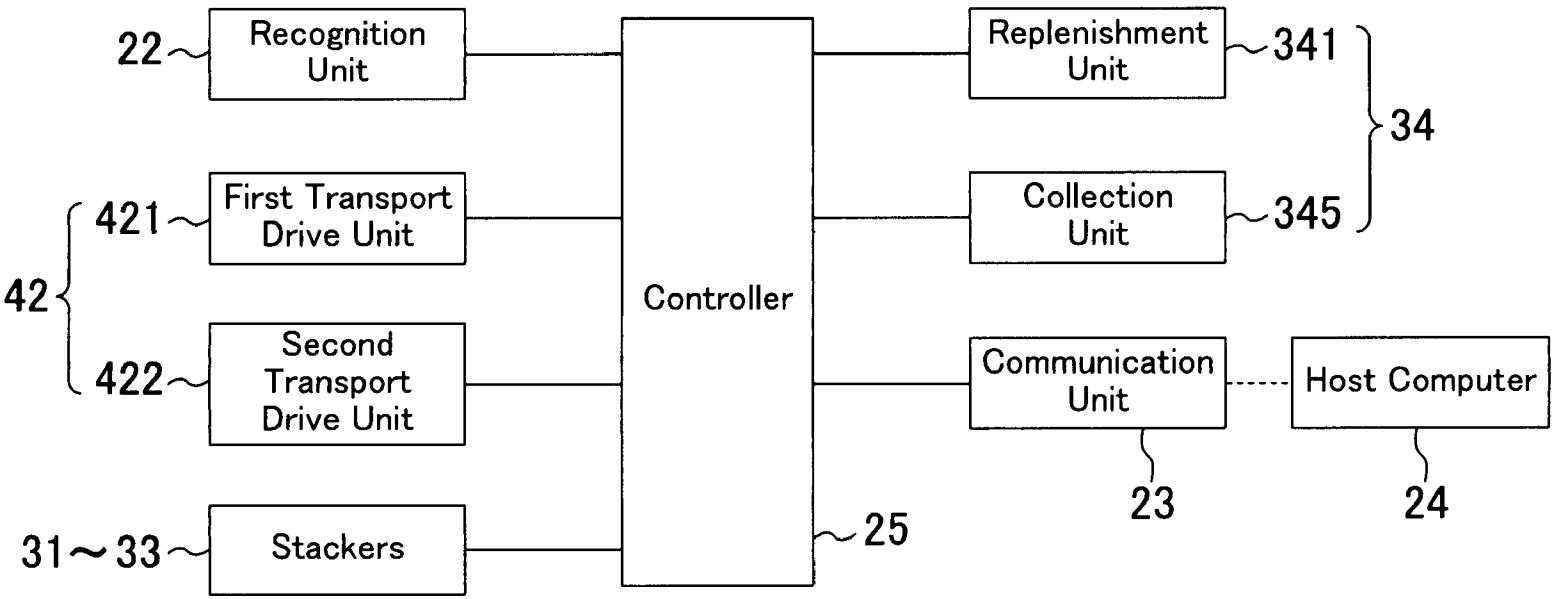
FIG. 3 is a block diagram illustrating a configuration related to control of the depositing and dispensing machine.

As shown in FIG. 3, the depositing and dispensing machine 1 further includes a communication unit 23 transmitting/receiving data to/from a host computer 24 through a communication line and a controller 25 controlling each of the components 22, 23, 31-34 and 42. The controller 25 receives a command from the host computer 24 as a host device of the depositing and dispensing machine 1 and thereby controls each of the components 22, 23, 31-34 and 42. Accordingly, the depositing and dispensing machine 1 performs various processes including depositing, dispensing, replenishment and collection (described later).

The depositing and dispensing machine 1 may be an individually operable apparatus which allows the controller 25 to control each of the components 22, 23, 31-34 and 42 based on a command given by a user through a certain interface.

The depositing and dispensing machine 1 is of a so-called recycling type which stores a banknote in each of the stackers 31-33 in the depositing process, and in the dispensing process, feeds the banknote out of there and discharges it through the depositing-and-dispensing port 21.

For easy explanation, the left and right sides of the depositing and dispensing machine 1 shown in FIG. 1 are referred to as the front and rear sides thereof, respectively.

The depositing-and-dispensing port 21 is a port for introducing a banknote when a user deposits it and discharging a banknote when it is dispensed to the user or at another such time. As shown in FIG. 1, the depositing-and-dispensing port 21 is arranged in a top part of a front face of the casing 2. When the user introduces a plurality of banknotes, the depositing-and-dispensing port 21 receives the banknotes one by one, while as described later, the depositing-and-dispensing port 21 dispenses a plurality of banknotes in the form of a batch with the front edges of the stacked banknotes being aligned.

The first to third stackers 31-33 are stacked vertically from the top in this order inside of the casing 2 and store banknotes dispensed (e.g., as change) from the depositing-and-dispensing port 21, for example, separately by the denominations thereof.

Each of the stackers 31-33 is of a so-called tape-winding type and winds banknotes one by one to store them and feeds the stored banknotes one by one in the order reverse to the winding order. Specifically, the box-shaped stackers 31-33 are each provided inside with a winding roller 35 rotatable both clockwise and counterclockwise in FIG. 1 and thereby winding a banknote.

The winding roller 35 is provided with a pair of tapes 361 and 362 whose tip ends are attached to a certain part of the outer circumferential surface of the winding roller 35. The base ends of the tapes 361 and 362 are attached to tape rollers 371 and 372, respectively, provided inside of the stackers 31-33. The tape rollers 371 and 372 rotate in synchronization with the winding roller 35. Specifically, when the winding roller 35 rotates counterclockwise in FIG. 1, the tape rollers 371 and 372 also rotate counterclockwise to thereby unreel the tapes 361 and 362 from the tape rollers 371 and 372, respectively and reel the unreeled tapes 361 and 362 onto the winding roller 35. On the other hand, when the winding roller 35 rotates clockwise in FIG. 1, the tape rollers 371 and 372 also rotate clockwise to thereby unreel the tapes 361 and 362 from the winding roller 35 and reel the unreeled tapes 361 and 362 onto the tape rollers 371 and 372, respectively.

The front faces of the stackers 31-33 are each formed with an inlet-and-outlet port 38 connecting the inside and the outside thereof, and through the inlet-and-outlet port 38, a banknote comes into and out of each of the stackers 31-33.

In order to store a banknote in each of the stackers 31-33, the banknote introduced through the inlet-and-outlet port 38 is held between the pair of tapes 361 and 362 and wound onto the winding roller 35. In this manner, each of the stackers 31-33 stores banknotes by winding them one by one onto the winding roller 35.

On the other hand, in order to feed a banknote out of each of the stackers 31-33, the winding roller 35 is driven in the reverse direction, and thereby, the banknote is fed together with the pair of tapes 361 and 362 out of the winding roller 35. In this manner, banknotes are fed one by one out of each of the stackers 31-33 through the inlet-and-outlet port 38 in the order reverse to the winding order.

The cassette 34 has a substantially rectangular box shape and includes a partition plate 34*a* arranged at a substantially middle position in the vertical directions. The partition plate 34*a* divides the space inside of the cassette 34 into two upper and lower regions. The upper region is a replenishment unit 341 storing banknotes and capable of feeding banknotes in store, while the lower region is a collection unit 345 storing banknotes but incapable of feeding banknotes in store.

As described later, the replenishment unit 341 is designed to store banknotes for replenishing each of the stackers 31-33. The replenishment unit 341 has a storage space for vertically stacking and storing banknotes, and a stage 342 for placing the banknotes is provided in the storage space. The stage 342 is vertically displaceable by a pantograph mechanism (see a solid line and a dot-dash line in FIG. 1) and hence is vertically displaced in accordance with the amount of banknotes placed thereon. Therefore, the position of the stage 342 is controlled such that the topmost among the banknotes stacked in the storage space is constantly located at the top end of the storage space.

The replenishment unit 341 is also provided inside with a belt conveyance mechanism 343 including a belt running on a plurality of pulleys. The belt conveyance mechanism 343 is arranged such that the belt is in contact with the topmost banknote placed in the storage space, and then, the belt conveyance mechanism 343 communicates with an inlet-and-outlet port 344 opening in the top face of the cassette 34. As described later, the thus-configured belt conveyance mechanism 343 places banknotes introduced through the inlet-and-outlet port 344 into the replenishment unit 341 one by one on the stage 342. Further, it feeds banknotes placed on the stage 342 one by one and discharges them through the inlet-and-outlet port 344 out of the replenishment unit 341.

The collection unit 345 is designed to store a rejected banknote or a banknote not supposed to circulate (e.g., a large-denomination banknote unusable as change). In the same way as the replenishment unit 341, the collection unit 345 has a storage space for vertically stacking and storing banknotes. A stage 346 which is vertically displaceable by a pantograph mechanism and which banknotes are placed on is provided in the storage space (see a solid line and a dot-dash line in FIG. 1).

The inside and the outside of the collection unit 345 connect by an inlet 347 formed at a middle position in the vertical directions of the rear wall of the cassette 34, and the collection unit 345 receives banknotes through the inlet 347. The collection unit 345 is provided near the inlet 347 and the storage space with a stacking wheel 348 rotating, tapping a banknote coming through the inlet 347 into the collection unit 345 and placing it onto the stage 346. Hence, the collection unit 345 is provided inside with only the stacking wheel 348 and thereby is incapable of feeding banknotes stored in the storage space out of the collection unit 34.

The transport path 41 is formed by combining transport belts running on pulleys, guide plates guiding a banknote, pairs of rollers sandwiching a banknote in the thickness directions and diverters arranged at predetermined positions in the transport path 41. The transport path 41 is capable of transporting not only a single banknote but also a batch of banknotes and includes a main transport path 411 and a return transport path 412.

The main transport path 411 connects the depositing-and-dispensing port 21 with each of the stackers 31-33 and the collection unit 345. The main transport path 411 extends horizontally from the depositing-and-dispensing port 21, passes the recognition unit 22 and then turns downward and extends along the vertically-piled stackers 31-33. The distal end of the main transport path 411 is connected to the third stacker 33.

The main transport path 411 can be divided into an upstream transport path 411*a* on the side of the stackers 31-33 with respect to the position shown by the two-dot dash line of FIG. 1, and a downstream transport path 411*b* on the side of the depositing-and-dispensing port 21 with respect to the position. The upstream transport path 411*a* and the downstream transport path 411*b* are each driven by different drive sources. Specifically, the upstream transport path 411*a* is driven by a first transport drive unit 421 (see FIG. 3), and the downstream transport path 411*b* is driven by a second transport drive unit 422 (see FIG. 3). Therefore, banknote transportation on the upstream transport path 411*a* and banknote transportation on the downstream transport path 411*b* can be mutually independently performed.

In the upstream transport path 411*a*, stacker diversion transport paths and a collection-unit diversion transport path divert at predetermined positions from the upstream transport path 411*a*. The stacker diversion transport paths each extend toward the first and second stackers 31 and 32 and the collection-unit diversion transport path extends toward the collection unit 345. The distal end of the collection-unit diversion transport path communicates with the inlet 347 when the cassette 34 is attached to the casing 2.

At the diversion positions of the diversion transport paths, diverters 431, 432 and 433 are provided which are each a claw-shaped member pivotable on a pivot axis and capable of distributing banknotes among the transport directions. The controller 25 controls the pivotal motion of each of the diverters 431, 432 and 433 such that a banknote traveling along the upstream transport path 411*a* is sent to any one of the first to third stackers 31-33 and the collection unit 345 and such that a banknote fed out of any one of the first to third stackers 31-33 is sent toward the depositing-and-dispensing port 21 on the upstream transport path 411*a*.

The return transport path 412 diverts from the downstream transport path 411*b* at a predetermined position on the side of the depositing-and-dispensing port 21 from the recognition unit 22 in the downstream transport path 411*b* and joins the downstream transport path 411*b* at a predetermined position on the side of the stackers 31-33 from the recognition unit 22 in the downstream transport path 411*b*. Therefore, the return transport path 412 and the downstream transport path 411*b* constitute a looped transport path 44 and as described later, the looped transport path 44 corresponds to a stacking mechanism (a bunching mechanism) stacking a plurality of banknotes into a batch. Hence, the same reference numeral 44 may be below given to the stacking mechanism.

Figure 2:
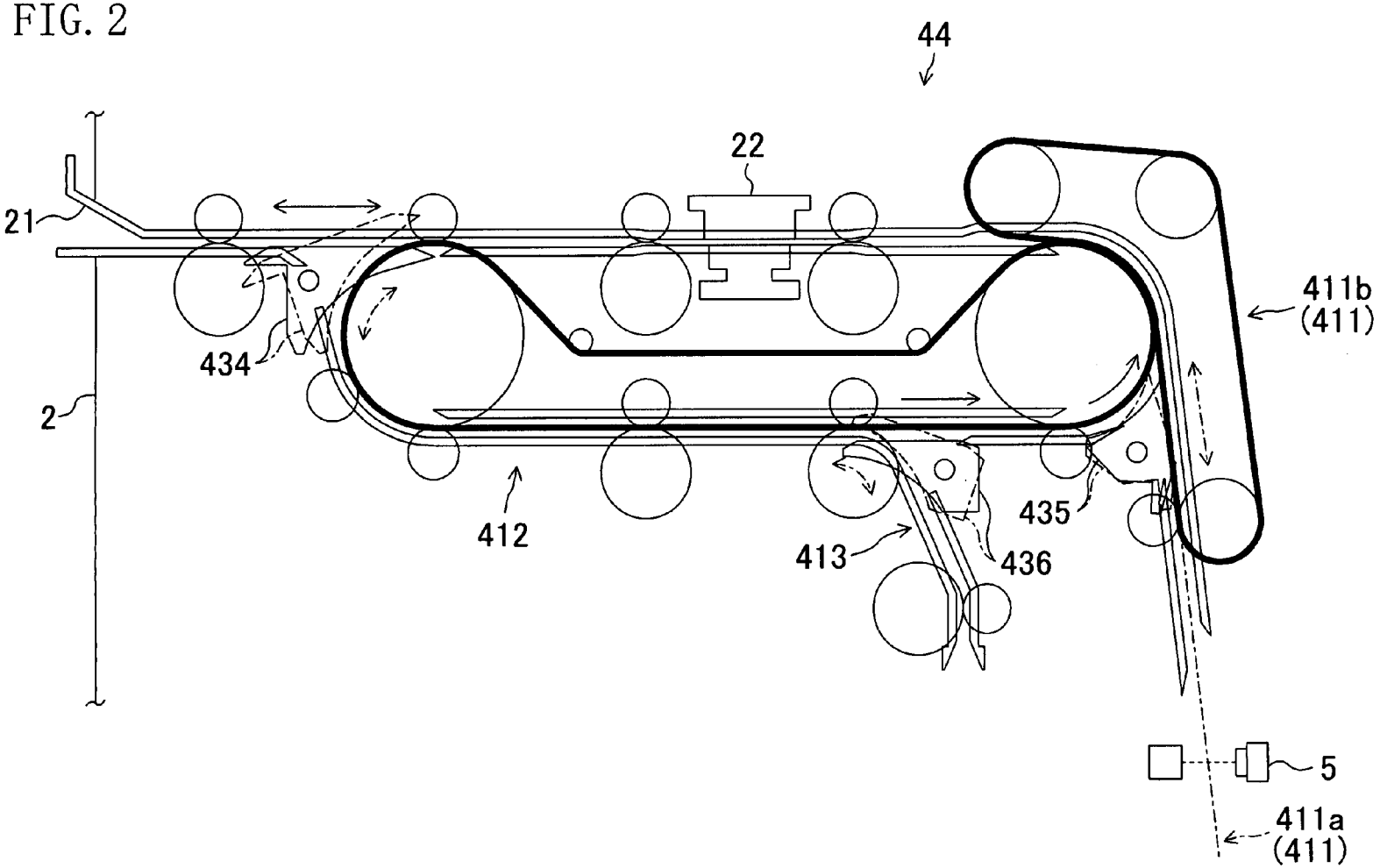
FIG. 2 is an enlarged view of a looped transport path according to the embodiment.

As also shown in FIG. 2, a diverter 434 is provided at the diversion position of the return transport path 412 from the downstream transport path 411*b* and a switching member 435 is provided near the joining position of the return transport path 412 with the downstream transport path 411*b*.

The diverter 434 is a claw-shaped member pivotable on a certain pivot axis, and the controller 25 performs control such that the posture of the diverter 434 is switched from a state where it is kept horizontal as shown by a solid line to a state where it is kept inclined as shown by a dot-dash line in FIG. 2, and vice versa. When the diverter 434 is in the inclination state, a banknote sent toward the depositing-and-dispensing port 21 on the downstream transport path 411*b* is sent to the side of the return transport path 412, or a banknote sent toward the diversion position on the return transport path 412 is returned to the downstream transport path 411*b* (see a dot-dash arrow in the figure).

On the other hand, when the diverter 434 is in the horizontal state, a banknote sent toward the depositing-and-dispensing port 21 on the downstream transport path 411*b* is sent straight to the depositing-and-dispensing port 21, or a banknote sent to the side of the stackers 31-33 on the downstream transport path 411*b* passes the diversion position straight (see a solid-line arrow in the figure).

Similarly, the switching member 435 is a claw-shaped member pivotable on a certain pivot axis, and the controller 25 performs control such that the posture of the switching member 435 is switched from a state where it is kept vertical as shown by a solid line to a state where it is kept inclined as shown by a dot-dash line in FIG. 2, and vice versa.

When the switching member 435 is in the vertical state, a banknote sent toward the joining position on the return transport path 412 is sent to the downstream transport path 411*b* (see a solid-line arrow in the figure).

On the other hand, when the switching member 435 is in the inclination state, a banknote sent toward the depositing-and-dispensing port 21 on the downstream transport path 411*b* passes the joining position straight, or a banknote sent to the side of the stackers 31-33 on the downstream transport path 411*b* passes the joining position straight (see a dot-dash arrow in the figure).

The drive source of the looped transport path 44 is formed by a belt running on a pair of pulleys, and this belt also forms a part of the downstream transport path 411*b*. Therefore, the return transport path 412 is driven together with the downstream transport path 411*b* by the second transport drive unit 422, and thereby, the looped transport path 44 is driven by the second transport drive unit 422. On the other hand, as described earlier, the upstream transport path 411*a* is driven by the first transport drive unit 421, and thereby, banknote transportation on the upstream transport path 411*a* and banknote transportation on the looped transport path 44 can be mutually independently performed.

In the return transport path 412, a replenishment-unit diversion transport path 413 diverts at a predetermined position from the return transport path 412 and extends toward the replenishment unit 341. The distal end of the replenishment-unit diversion transport path 413 communicates with the inlet-and-outlet port 344 when the cassette 34 is attached to the casing 2. At the diversion position of the replenishment-unit diversion transport path 413 from the return transport path 412, a diverter 436 is provided which is a claw-shaped member pivotable on a pivot axis. The controller 25 controls the pivotal motion of the diverter 436 such that a banknote traveling toward the joining position on the return transport path 412 is sent straight to the side of the joining position (see a solid-line arrow in the same figure), or such that the banknote is sent toward the replenishment unit 341 (see a dot-dash arrow in the figure). Further, a banknote fed out of the replenishment unit 341 can also be sent to the main transport path (the downstream transport path 411*b*) via the diversion position of the return transport path 412.

The transport path 41 is provided with banknote detection sensors such as optical sensors suitably arranged at each predetermined position and detecting the arrival of a banknote. FIG. 1 or the like shows only a banknote detection sensor 5 near the top end of the upstream transport path 411*a*, and the banknote detection sensor 5 is used in a banknote stacking operation described later.

The first and second transport drive units 421 and 422 each include, as the transport drive source, a motor (not shown) capable of controlling the rotation angle or rotational speed thereof. For example, the motor may be a stepping motor or a servo motor.

Figure 4:
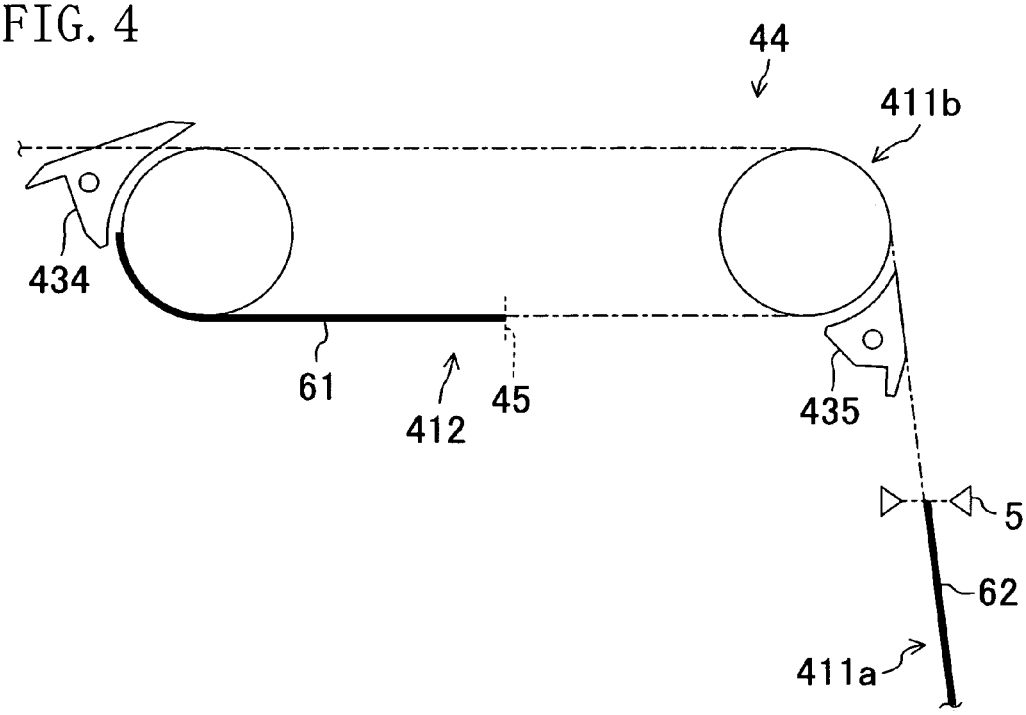
FIG. 4 is a view illustrating the first step of a banknote stacking operation in the looped transport path.
Figure 5:
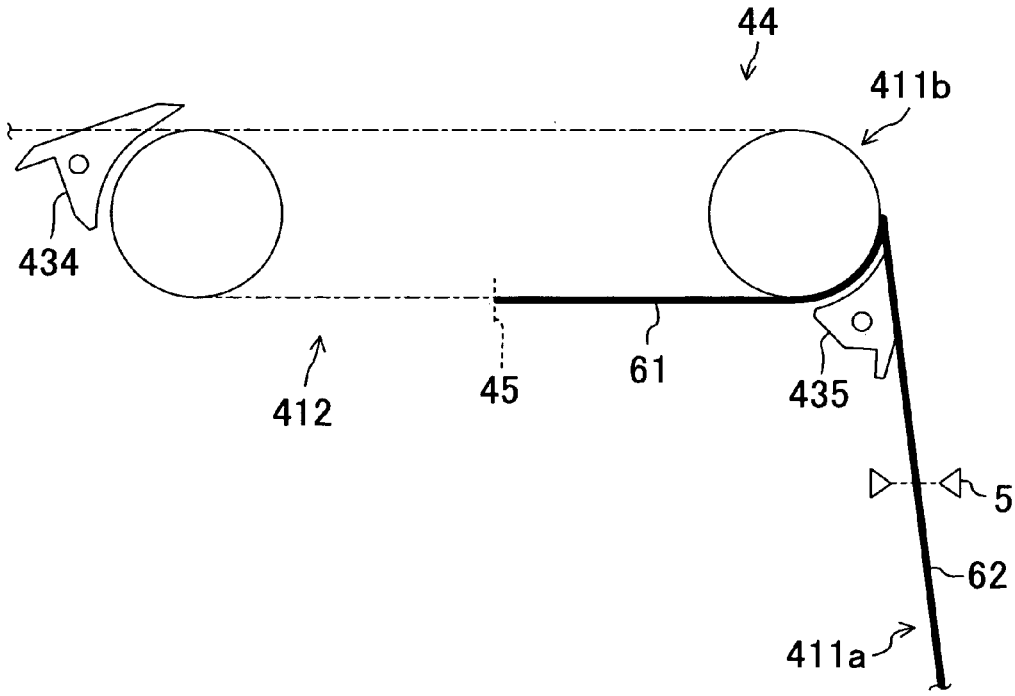
FIG. 5 is a view illustrating the second step of the banknote stacking operation in the looped transport path.

Next, a banknote stacking operation performed by the stacking mechanism 44 will be described with reference to FIGS. 4 to 6. First, a banknote (a first banknote 61) fed out of any one of the stackers 31-33 travels from the upstream transport path 411*a* to the downstream transport path 411*b* and reaches the diversion position of the return transport path 412. At this time, as shown in FIG. 4, the diverter 434 is in the inclination state, and thereby, the first banknote 6 is sent to the return transport path 412 and then situated at a predetermined standby position 45 on the return transport path 412.

Next, another banknote (a second banknote 62) is fed out of any one of the stackers 31-33 with the first banknote 61 kept on standby, and the second banknote 62 is sent toward the depositing-and-dispensing port 21 on the upstream transport path 411*a*. Then, the banknote detection sensor 5 detects the second banknote 62, and specifically, that the front edge of the second banknote 62 has reached the position of the banknote detection sensor 5.

Upon receiving the detection result of the banknote detection sensor 5, the controller 25 controls the first and second transport drive units 421 and 422 such that the first banknote 61 on the return transport path 412 and the second banknote 62 on the upstream transport path 411*a* are transported in synchronization with each other. Then, as shown in FIG. 5, the front edges of the two banknotes 61 and 62 are aligned at the joining position of the downstream transport path 411*b* and the return transport path 412. In this state, the first and second banknotes 61 and 62 are transported along the downstream transport path 411*b* and thereby are stacked into a batch with the front edges being aligned.

Figure 6:
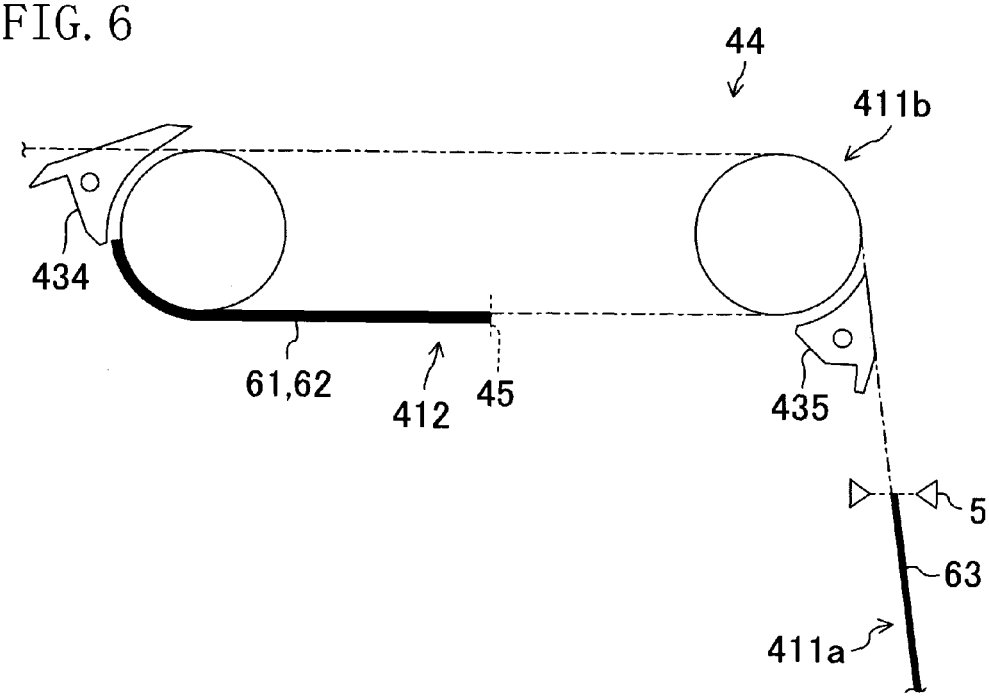
FIG. 6 is a view illustrating the third step of the banknote stacking operation in the looped transport path.

The batch of the banknotes 61 and 62 is sent toward the depositing-and-dispensing port 21 on the downstream transport path 411*b*, sent again to the side of the return transport path 412 and situated at the standby position 45 (see FIG. 6). Then, a new banknote (a third banknote 63) is detected by the banknote detection sensor 5, and as described above, both the batch of the banknotes 61 and 62 and the third banknote 63 are transported and thereby stacked at the joining position with the front edges thereof being aligned.

In the thus-configured stacking mechanism 44 provided with a looped transport path, every time a paper sheet or a batch of paper sheets revolves through the looped transport path 44, a new paper sheet can be stacked thereon one after another into a batch. At this time, the stacking mechanism 44 is capable of stacking paper sheets with the front edges thereof being aligned and thereby creating the batch of aligned paper sheets even though each paper sheet is different in size.

Figure 7:
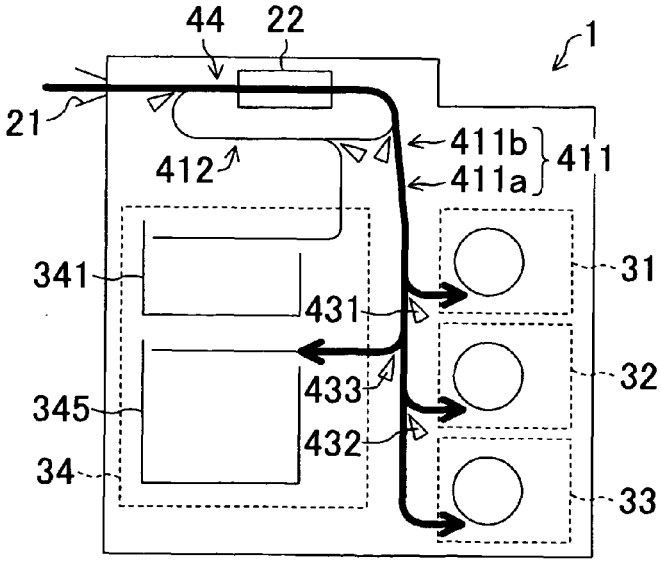
FIG. 7 is a view illustrating banknote transport routes when a banknote is deposited.

Next, each process performed by the thus-configured depositing and dispensing machine 1 will be described with reference to FIGS. 7 to 11. FIG. 7 is a view illustrating banknote transport routes when a banknote is deposited. In the depositing process, a user introduces banknotes one by one from the depositing-and-dispensing port 21 and the recognition unit 22 recognizes whether each of the introduced banknotes is acceptable or not. A banknote recognized as acceptable is sent to the side of the stackers 31-33 along the main transport path 411 while a rejected banknote recognized as unacceptable is discharged from the depositing-and-dispensing port 21.

On the basis of the recognition result of the recognition unit 22, the controller 25 controls the diverters 431, 432 and 433 such that banknote sent to the side of the stackers 31-33 is stored in any one of the stackers 31-33 and the collection unit 345.

Figure 8:
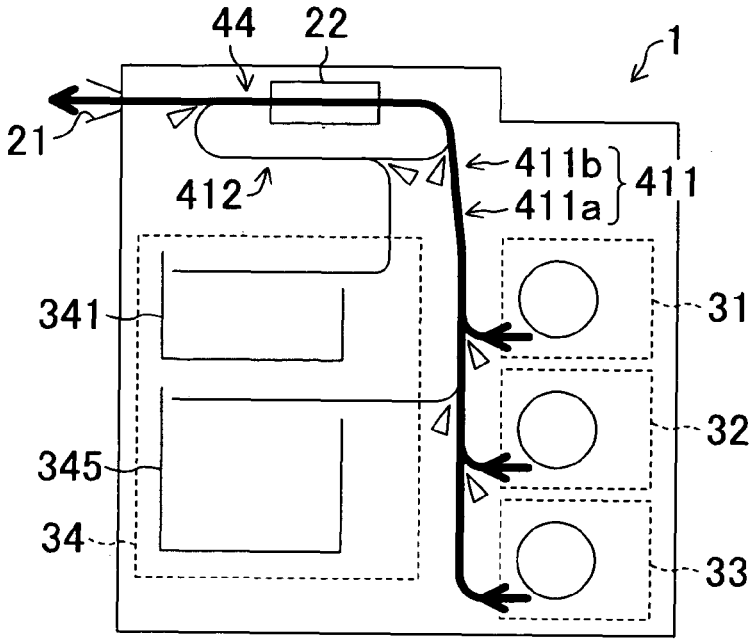
FIG. 8 is a view illustrating banknote transport routes when a single banknote is dispensed through a depositing-and-dispensing port.

FIG. 8 shows a process of dispensing a single banknote from the depositing-and-dispensing port 21. The dispensing process corresponds to the two of a so-called dispensing process of feeding a banknote of a designated denomination out of each of the stackers 31-33 and dispensing the banknote to the user and a cancelling process of, when banknote depositing is canceled in the above depositing process, returning the introduced banknote to the user.

In short, in the dispensing process, a banknote fed out of each of the stackers 31-33 is transported along the main transport path 411 and dispensed through the depositing-and-dispensing port 21.

Figure 9:
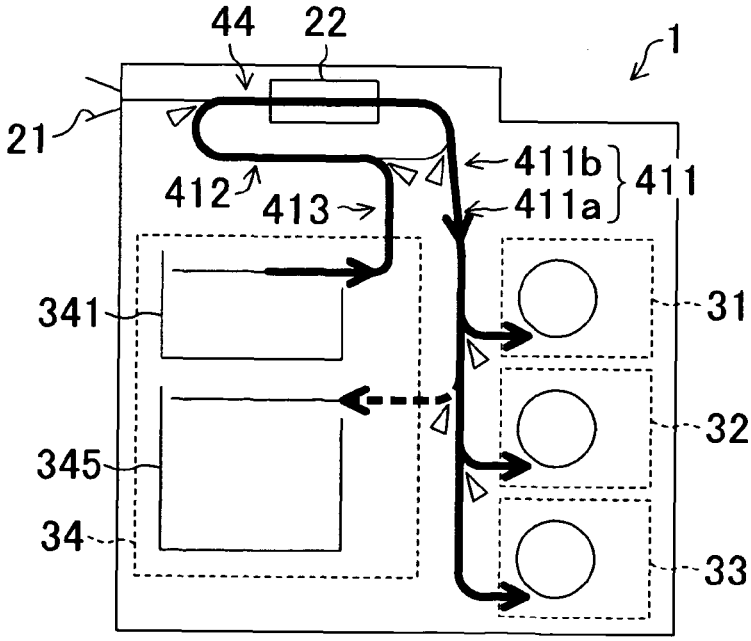
FIG. 9 is a view illustrating banknote transport routes when a replenishment unit replenishes each stacker with a banknote.

FIG. 9 shows a process of replenishing each of the stackers 31-33 with a banknote. The replenishment process is a process of transporting a banknote stored in the replenishment unit 341 to each of the stackers 31-33 and storing the banknote therein. Here, the cassette 34 provided with the replenishment unit 341 containing banknotes is attached to the casing 2. The replenishment unit 341 may store banknotes with the denominations thereof mixed.

Specifically, in the replenishment process, banknotes fed one by one from the replenishment unit 341 each pass through the replenishment-unit diversion transport path 413 and the return transport path 412, enter the downstream transport path 411*b* and are recognized by the recognition unit 22. If a banknote is recognized as storable, the banknote is sent to the side of the stackers 31-33 along the main transport path 411 and stored, for example, in the one of the stackers 31-33 corresponding to the denomination of the recognized banknote (see a solid-line arrow in the same figure). On the other hand, if a banknote is not recognized as storable, the banknote is rejected and sent to the collection unit 345 along the main transport path 411 and stored therein (see a broken-line arrow in the figure).

In the replenishment process, simply using the single cassette 34, banknotes initially available at the time when the depositing and dispensing machine 1 comes into operation or the like can be stored in bulk in each of the stackers 31-33, thereby making the operation more convenient. In addition, the employment of only the single cassette 34 offers advantages in that the cassette 34 can be more easily carried and guarded with simpler measures against theft.

Figure 10:
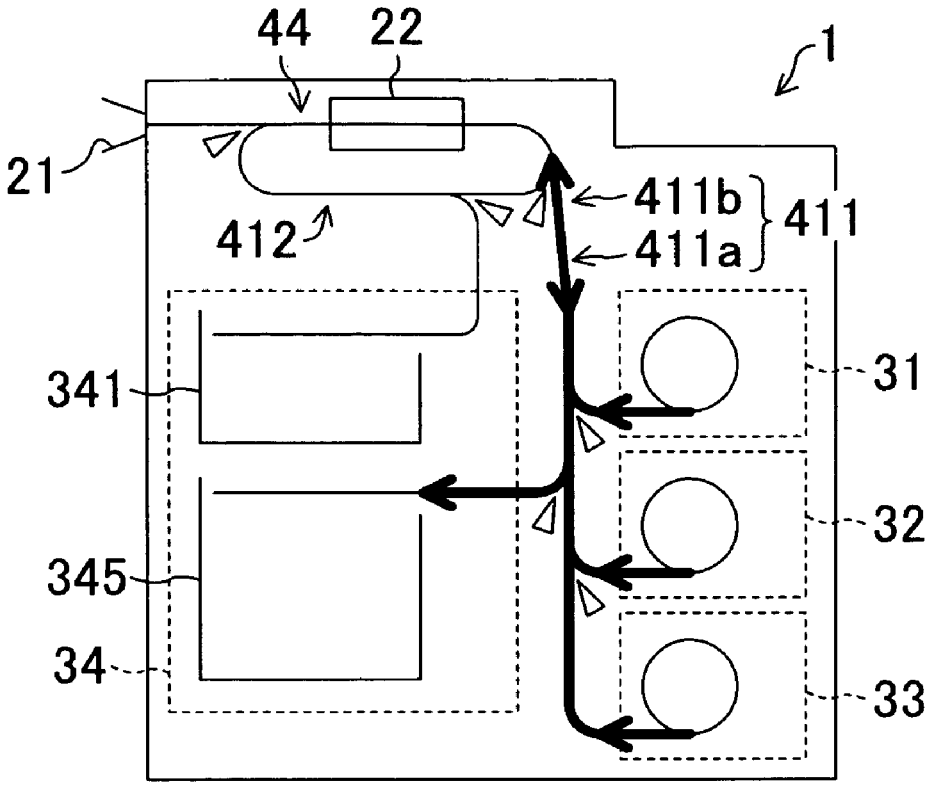
FIG. 10 is a view illustrating banknote transport routes when a collection unit collects a banknote from each stacker.

FIG. 10 shows a collection process of storing a banknote stored in each of the stackers 31-33 in the collection unit 345 of the cassette 34. In the collection process, each banknote fed one by one from each of the stackers 31-33 is sent toward the depositing-and-dispensing port 21 along the upstream transport path 411*a*, thereafter is switched back and then transported through the upstream transport path 411*a* to the collection unit 345 and stored therein. In this manner, all banknotes stored in each of the stackers 31-33 are stored in the collection unit 345, then the cassette 34 is detached from the casing 2 and thereby the banknotes inside of the depositing and dispensing machine 1 are collected.

In the collection process, each banknote fed one by one from each of the stackers 31-33 may be sent up to the recognition unit 22, recognized and counted there, and then stored in the collection unit 345.

Figure 11:
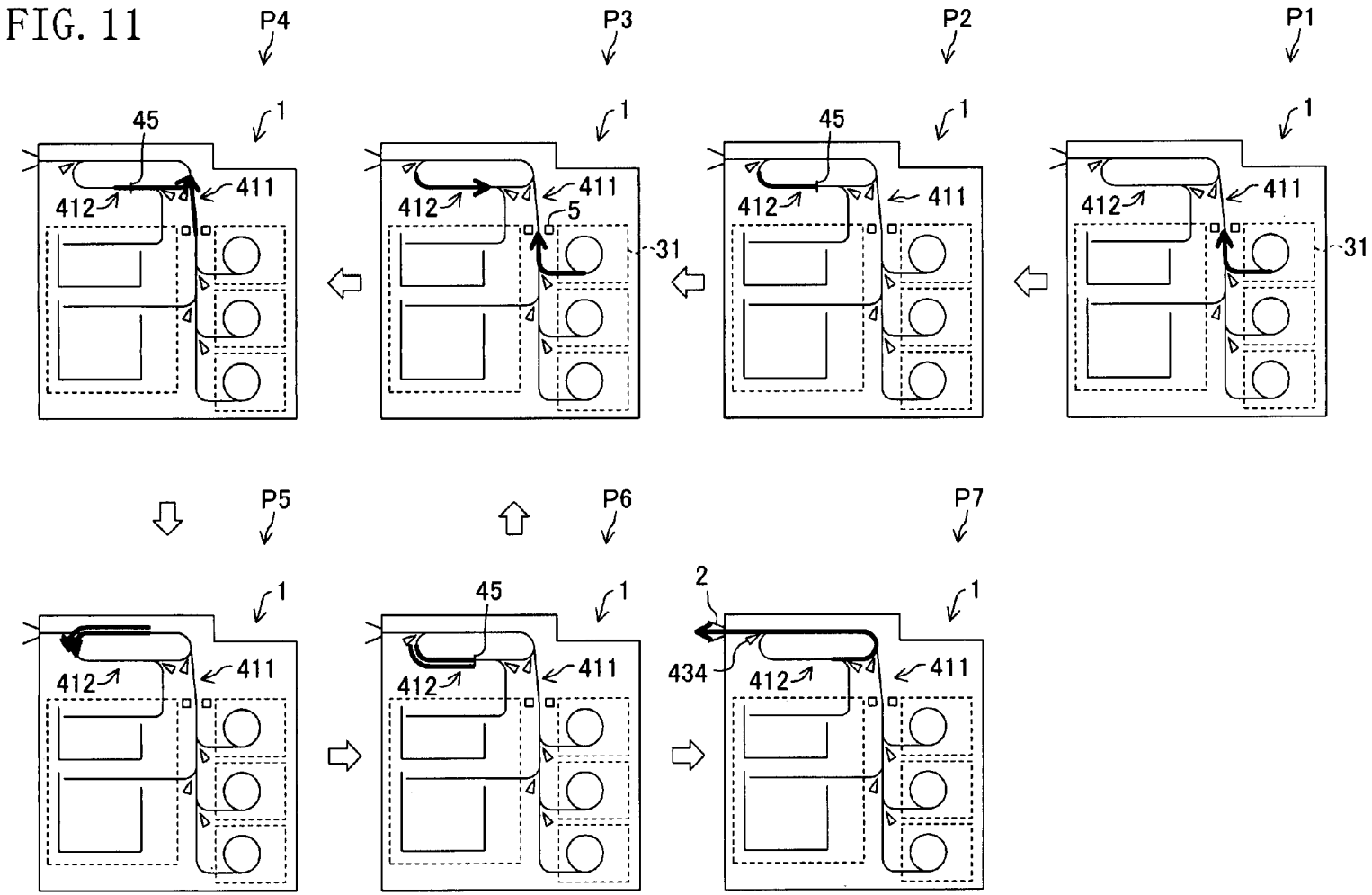
FIG. 11 is views illustrating a banknote transport route when a plurality of banknotes are dispensed through the depositing-and-dispensing port.

FIG. 11 shows the steps of a process of dispensing two or more banknotes. Similarly to the above, this dispensing process also corresponds to two dispensing process and cancelling process. In the dispensing process, two or more banknotes are stacked into a batch with the front edges thereof being aligned in the stacking mechanism 44, and then, the batch is dispensed from the depositing-and-dispensing port 21. FIG. 11 illustrates that banknotes fed from the first stacker 31 are dispensed, but needless to say, the one from which banknotes are fed is not limited to the first stacker 31, and hence, may be any one of the stackers 31-33. Further, in order to dispense banknotes mutually different in denomination, banknotes of each denomination are fed from the corresponding one of the stackers 31-33.

In the dispensing process, first in a step P1, a banknote is fed from the first stacker 31 and held on standby at the standby position 45 on the return transport path 412 (see a step P2).

Then, the next banknote is fed from the first stacker 31 (see a step P3) and sent toward the depositing-and-dispensing port 21 along the main transport path 411. As described earlier, based on the detection result of the banknote detection sensor 5, the transportation of the banknote on the main transport path 411 and the transportation of the banknote on the return transport path 412 are controlled such that the two banknotes are stacked at the joining position thereof with the front edges being aligned (see a step P4). At the diversion position, the batch formed by the two banknotes is led into the return transport path 412 (see a step P5) and held on standby at the standby position 45 (see a step P6).

When a new banknote is further dispensed, the process returns to the step P3 from the step P6, and each of the steps P3-P6 is repeated. In this manner, new banknotes are stacked one after another on the preformed batch with the front edges thereof being aligned. When a required number of banknotes have been stacked, the process shifts from the step P6 to a step P7, and in the step P7, the diverter 434 is switched into the horizontal state to thereby dispense the batch of banknotes through the depositing-and-dispensing port 21.

Here, the step P4 is supposed to be followed by the steps P5 and P6 to thereby lead a batch of banknotes into the return transport path 412. However, when a required number of banknotes have been stacked, the process may shift directly to the step P7 from the step P4 to thereby dispense the batch of banknotes from the depositing-and-dispensing port 21 without leading the batch into the return transport path 412.

As described so far, when dispensing a plurality of banknotes, the depositing and dispensing machine 1 stacks the banknotes into a batch with the front edges thereof being aligned and dispenses the batch from the depositing-and-dispensing port 21. Therefore, even if the banknotes are mutually different in size, a user can pick up the batch of banknotes more easily and grab the banknotes without leaving any of them.

Furthermore, the stacking mechanism stacking banknotes into a batch in this manner is configured by including the looped transport path 44, and hence, revolves the banknotes through the looped transport path 44 and thereby stacks them into the batch. Therefore, the configuration of the stacking mechanism becomes simpler and banknotes can be slacked at a higher speed.

Moreover, a part of the looped transport path 44 is formed by the main transport path 411 connecting the depositing-and-dispensing port 21 and each of the stackers 31-33. Therefore, the space necessary for providing the stacking mechanism can be reduced, for example, as compared with the case where a looped transport path is separately provided from the main transport path 411 to thereby form a stacking mechanism.

In addition, the return transport path 412 forming the other part of the looped transport path 44 is connected to the replenishment-unit diversion transport path 413. The return transport path 412 forms a part of the transport path connecting the main transport path 411 and the cassette 34 (the replenishment unit 341). In other words, the return transport path 412 for forming the stacking mechanism is also employed for the different purpose. This makes it possible to further reduce the space necessary for providing the stacking mechanism and thereby downsize the depositing and dispensing machine 1.

Furthermore, in the depositing and dispensing machine 1, the tape-winding type stackers (the first to third stackers 31-33) are employed as the storage unit storing banknotes. Therefore, banknotes can be fed one by one from the stackers and sent to the joining position with reliability, and thereby, stacked with accuracy. However, the storage unit is not limited to the tape-winding type stackers, and hence, may have any other configurations as long as it is capable of feeding banknotes. For example, if the storage unit feeds two stacked banknotes erroneously, the stacking state thereof may be detected by the time they reach the joining position, thereby stacking the banknotes one by one with reliability.

Moreover, the depositing and dispensing machine 1 stacks a plurality of banknotes into a batch when dispensing them. However, as is different from this, it may be configured to, when depositing banknotes, create the batch thereof using the looped transport path 44 and escrow the batch of banknotes. According to this configuration, if the depositing is canceled, the batch of banknotes in escrow can be discharged from the depositing-and-dispensing port 21. This configuration can be realized by changing the configuration of the drive source of each of the transport paths 411 and 412 from the above configuration. If the depositing is confirmed, then the created batch may be once stored in the replenishment unit 341, and using the belt conveyance mechanism 343 arranged therein, the batch of banknotes can be fed one by one. As a result, the banknotes can be stored one by one in each of the stackers 31-33, even though the batch thereof is created during the escrow.

In addition, the stacking mechanism 44 stacks banknotes into a batch with the front edges thereof being aligned, but this is not limitative. The stacking mechanism 44 may stack banknotes with any parts thereof being aligned, and hence, with the rear edges thereof being aligned or with the middle parts thereof being aligned.

The object handled by the paper sheet handling apparatus of the present invention is not limited to banknotes. The paper sheet handling apparatus is capable of handling all kinds of paper sheets, such as checks and tickets as well as banknotes.

Furthermore, the paper sheet handling apparatus is not limited to an apparatus which both stores (deposits) and discharges (dispenses) paper sheets. The paper sheet handling apparatus may be applied to an apparatus which either stores or discharges paper sheets.

Moreover, the paper sheet handling apparatus may be applied to a variety of apparatuses, for example, self-service registers used in various shops, various ticket vending machines, parking charge registers, etc.

Industrial Applicability

As described above, the present invention is useful for a handling apparatus and a handling method for various paper sheets capable of stacking a plurality of paper sheets into a batch with the paper sheets being aligned and capable of performing the stacking procedure rapidly without a larger space inside of the handling apparatus.

DESCRIPTION OF REFERENCE CHARACTERS

1 Depositing and dispensing Machine (Paper Sheet Handling Apparatus)
2 Casing
21 Depositing-and-dispensing Port (Opening)
25 Controller
31 First Stacker (Storage Unit)
32 Second Stacker (Storage Unit)
33 Third Stacker (Storage Unit)
34 Cassette
411 Main Transport Path
412 Return Transport Path
413 Replenishment-unit Diversion Transport Path (Diversion Transport Path)
42 Transport Drive Unit (Transport Unit)
5 Banknote Detection Sensor (Detection Unit)

The invention claimed is:

1. A paper sheet handling apparatus, comprising:

a casing having an opening through which a paper sheet passes;

a storage unit arranged inside of the casing and storing the paper sheet;

a transport unit which includes a main transport path connecting the opening and the storage unit and a return transport path diverting from the main transport path at a predetermined position thereof and joining the main transport path at a position upstream in the transport direction from the diversion position, and transports the paper sheet along the main transport path and the return transport path;

a detection unit arranged at a detection position upstream in the transport direction from the joining position of the main transport path and detecting the arrival of the paper sheet transported along the main transport path at the detection position; and a controller controlling the transport unit based on the detection result of the detection unit such that a plurality of the paper sheets are stacked into a batch with certain parts of the paper sheets being aligned, wherein the controller performs a procedure comprising the steps of (I) leading, at the diversion position, the paper sheet transported along the main transport path into the return transport path, (II) transporting a subsequent paper sheet along the main transport path, and (III) controlling the transportation of the paper sheet on the return transport path so that the paper sheet on the return transport path is transported toward the main transport path and the transportation of the subsequent paper sheet on the main transport path respectively in response to the arrival of the subsequent paper sheet at the detection position such that the two paper sheets are stacked into a batch at the joining position with certain parts of the paper sheets being aligned.

2. A paper sheet handling apparatus, comprising:

a casing having an opening through which a paper sheet passes;

a storage unit arranged inside of the casing and storing the paper sheet;

a transport unit which includes a main transport path connecting the opening and the storage unit and a return transport path diverting from the main transport path at a predetermined position thereof and joining the main transport path at a position upstream in the transport direction from the diversion position, and transports the paper sheet along the main transport path and the return transport path;

a detection unit arranged at a detection position upstream in the transport direction from the joining position of the main transport path and detecting the arrival of the paper sheet transported along the main transport path at the detection position; and a controller controlling the transport unit based on the detection result of the detection unit such that a plurality of the paper sheets are stacked into a batch with certain parts of the paper sheets being aligned, wherein the controller performs a procedure comprising the steps of:

(I) leading, at the diversion position, the paper sheet transported along the main transport path into the return transport path, (II) transporting a subsequent paper sheet along the main transport path, (III) controlling the transportation of the paper sheet on the return transport path and the transportation of the subsequent paper sheet on the main transport path respectively in response to the arrival of the subsequent paper sheet at the detection position such that the two paper sheets are stacked into a batch at the joining position with certain parts of the paper sheets being aligned, (IV) transporting the batch along the main transport path and leading, at the diversion position, the batch into the return transport path, (V) transporting a subsequent paper sheet along the main transport path, (VI) controlling the transportation of the batch on the return transport path and the transportation of the subsequent paper sheet on the main transport path respectively in response to the arrival of the subsequent paper sheet at the detection position such that the batch and the subsequent paper sheet are stacked into a new batch at the joining position with certain parts of the paper sheets being aligned, and (VII) repeating the steps (IV)-(VI) in order as many times as required and creating a batch of a predetermined number of stacked paper sheets.

3. The paper sheet handling apparatus of claim 2, wherein the controller further performs the step of (VIII) transporting the batch along the main transport path and discharging the batch out of the casing through the opening.

4. The paper sheet handling apparatus of claim 2, wherein, when paper sheets are discharged, the controller feeds the paper sheets one by one out of the storage unit, stacks the fed paper sheets into a batch with certain parts of the paper sheets being aligned and discharges the batch out of the casing through the opening.

5. The paper sheet handling apparatus of claim 2, wherein the storage unit stores paper sheets while winding the paper sheets one by one and feeds the wound paper sheets one by one.

6. The paper sheet handling apparatus of claim 2, further comprising a cassette which is detachably attached to the casing and capable of storing a paper sheet for replenishing the storage unit and a paper sheet collected from the storage unit, wherein the cassette is connected to the return transport path via a diversion transport path diverting from the return transport path.

7. A paper sheet handling method for discharging a paper sheet out of a casing through a discharge port, the method comprising the steps of:

(i) transporting a paper sheet fed out of a storage unit inside of the casing along a main transport path and leading the paper sheet into a return transport path diverting from the main transport path;

(ii) feeding a subsequent paper sheet out of the storage unit and transporting the subsequent paper sheet along the main transport path;

(iii) controlling the transportation of the paper sheet on the return transport path and the transportation of the subsequent paper sheet on the main transport path respectively in response to the arrival of the subsequent paper sheet at a predetermined arrival position of the main transport path such that the paper sheets are stacked into a batch at a joining position of the return transport path and the main transport path with certain parts of the paper sheets being aligned; and (iv) transporting the batch along the main transport path and discharging the batch out of the casing through the discharge port.

8. The paper sheet handling method of claim 7, further comprising the steps of, after the step (iii), (v) transporting the batch along the main transport path and leading, at the diversion position, the batch into the return transport path, (vi) transporting a subsequent paper sheet along the main transport path, (vii) controlling the transportation of the batch on the return transport path and the transportation of the subsequent paper sheet on the main transport path respectively in response to the arrival of the subsequent paper sheet at the arrival position such that the batch and the subsequent paper sheet are stacked into a new batch at the joining position with certain parts of the paper sheets being aligned, and (viii) performing the step (iv) after repeating the steps (v)-(vii) as many times as required.

9. A paper sheet handling method for accepting a paper sheet introduced into an opening, the method comprising the steps of:

(i) transporting the paper sheet introduced into the opening along a main transport path and leading the paper sheet into a return transport path diverting from the main transport path;

(ii) transporting a subsequent paper sheet introduced into the opening along the main transport path;

(iii) controlling the transportation of the paper sheet on the return transport path so that the paper sheet on the return transport path is transported toward the main transport path and the transportation of the subsequent paper sheet on the main transport path respectively in response to the arrival of the subsequent paper sheet at a predetermined arrival position of the main transport path such that the paper sheets are stacked into a batch at a joining position of the return transport path and the main transport path with certain parts of the paper sheets being aligned;

(iv) leading, at the diversion position, the batch into the return transport path; and (v) repeating the steps (ii)-(iv) every time a paper sheet is introduced into the opening.

10. A paper sheet handling method for accepting a paper sheet introduced into an opening, the method comprising the steps of:

(i) transporting the paper sheet introduced into the opening along a main transport path and leading the paper sheet into a return transport path diverting from the main transport path;

(ii) transporting a subsequent paper sheet introduced into the opening along the main transport path;

(iii) controlling the transportation of the paper sheet on the return transport path and the transportation of the subsequent paper sheet on the main transport path respectively in response to the arrival of the subsequent paper sheet at a predetermined arrival position of the main transport path such that the paper sheets are stacked into a batch at a joining position of the return transport path and the main transport path with certain parts of the paper sheets being aligned;

(iv) leading, at the diversion position, the batch into the return transport path;

(v) repeating the steps (ii)-(iv) every time a paper sheet is introduced into the opening; and (vi) transporting the formed batch to a feeding unit, feeding the paper sheets of the batch one by one out of the feeding unit and storing the paper sheets in a storage unit.

11. The paper sheet handling method of claim 10, further comprising the step of (vii) transporting the formed batch along the main transport path and discharging the batch through the opening when the storage of the paper sheets is canceled.

* * * * *